United States Patent [19]

Heard, Jr.

[11] 4,276,870

[45] Jul. 7, 1981

[54] FIREPLACE DEVICE

[76] Inventor: Charles B. Heard, Jr., 569 Brandy Creek Cir., Lawrenceville, Ga. 30245

[21] Appl. No.: 124,815

[22] Filed: Feb. 26, 1980

[51] Int. Cl.[3] ..... F24C 15/22

[52] U.S. Cl. ..... 126/141; 126/132

[58] Field of Search ..... 126/120, 121, 132, 141

[56] References Cited

U.S. PATENT DOCUMENTS

| | | | |
|---|---|---|---|
| 11,123 | 11/1890 | McMahen | 126/141 |
| 17,235 | 5/1857 | Seitz | 126/141 |
| 27,886 | 4/1860 | Card | 126/141 |
| 39,836 | 9/1863 | Ross | 126/141 |
| 239,873 | 4/1881 | Southward | 126/141 |
| 280,411 | 7/1883 | Spear | 126/141 |
| 506,331 | 10/1893 | McGahan | 126/141 |
| 1,322,603 | 11/1919 | Norman | 126/120 |
| 1,507,473 | 9/1924 | Dray | 126/120 |
| 1,582,737 | 4/1926 | Crawford | 126/141 |
| 2,103,171 | 12/1937 | Nilson | 126/120 |
| 2,307,600 | 1/1943 | Munters et al. | 126/132 |
| 3,802,415 | 4/1974 | Richard | 126/120 |
| 3,896,785 | 7/1975 | Nelson | 126/121 |
| 3,921,618 | 11/1975 | Quiry | 126/120 |
| 3,952,722 | 4/1976 | Yamagishi | 126/141 |

FOREIGN PATENT DOCUMENTS

| | | | |
|---|---|---|---|
| 22779 | of 1902 | United Kingdom | 126/141 |
| 613467 | 11/1948 | United Kingdom | 126/141 |

*Primary Examiner*—Samuel Scott
*Assistant Examiner*—Lee E. Barrett

[57] ABSTRACT

A fireplace device which is especially suited to the retrofitting of existing fireplaces and stoves in order to increase their ability to heat living areas includes a curved portion that is connected to a planar portion mounted on legs that support the device above a hearth. The device may be constructed so that it is adjustable with respect to a lower depending wall of the fireplace opening in order to maximize the radiative and convective heat which is transferred into the living area.

2 Claims, 5 Drawing Figures

FIREPLACE DEVICE

TECHNICAL FIELD

This invention relates to a fireplace device and, more particularly, to a device with which existing fireplaces may be retrofitted or which may be embodied in new fireplace construction to maximize the heat which is provided to a room in which the fireplace is situated.

BACKGROUND

A fireplace generally includes a cavity which is commonly referred to as a firebox and which is defined by masonry walls, a hearth, and a rear wall with the cavity connected through a flue to a chimney. The draught of cold outside air which travels downwardly within the chimney is redirected upwardly by a damper which provides a necked down opening between its free end and a front wall of the chimney. Energy sources such as coal, wood and the like which are supported for burning adjacent the hearth cause the room air to be heated.

Unfortunately, in standard fireplaces, the heated air is drawn upwardly between the free end of the damper and the chimney wall at the flue and flows upwardly and out the chimney. It is well known that while a fireplace is a desirable feature in a home from the standpoint of nostalgia and aesthetic values, it may result in a net outflow or loss of heat from a room rather than increase the temperature thereof. The heat loss occurs because of the relatively large volume of air that must flow into the fireplace to sustain combustion with the products of combustion being exhausted up through the chimney. In the past, the air required for combustion has been drawn from inside the house, with the result that air heated by a central heating system is pulled from the house to sustain a fire that heats radiantly only the area adjacent the fireplace opening.

As a result of today's energy crisis, a number of devices for improving the efficiency of existing fireplaces have appeared in the marketplace. A well known grate supported on legs for holding coal or wood has been replaced in some fireplaces by a device which comprises relatively large circular tubes for heating air and redirecting same back into the room. Various arrangements of fans are used to retrofit existing fireplaces and are integral parts of new installations for redirecting heated air into the room rather than permit it to escape through the flue with no benefit to the occupants of the room. In still other arrangements, such as, for example, an air grille fitted into a raised hearth, exterior air is drawn into the house to feed the combustion.

In the most current prior art, one triangular arrangement of plates which are installed between side walls of an existing fireplace in overlying relation to a heat source serves to deflect heat into a room and to direct residual combustion gases to the fireplace flue as well as to heat the overlying upper panel so that it radiates heat into the room. (See U.S. Pat. No. 3,952,722) Another device which is shown in U.S. Pat. No. 3,802,415 channels the flow of gases in the throat of a chimney without relying on a conventional damper and masonry projection and regulates the draught.

Early on in the prior art, J. Spear in U.S. Pat. No. 280,411 disclosed a damper comprising two pivotable valves which were both oriented horizontally to close off the room to cold outside air and the front one of which was oriented angularly downwardly toward the heat source to reflect heat and light into the room. J. Southward in his U.S. Pat. No. 239,873 accomplished the same result with a plate which was pivotally mounted along a top rear edge of his energy source holder, and T. F. Card in U.S. Pat. No. 27,886 shows a curved plate cantilevered out from a rear wall of the firebox and having its free upper edge supported by tie rods from the rear wall. D. A. Ross, patentee of U.S. Pat. No. 39,836 forms a part of the background art of this invention in that he shows a fireplace equipped with an ogee rotating back which may be swung rearwardly to allow the charging with an energy source after which it is allowed to come to rest in engagement with the front of the fireplace opening.

None of the above-mentioned devices which are the subjects of patents nor those which are presently on the market provide the consumer with a means for expeditiously retrofitting an existing fireplace to cause substantially more of the heat generated to enter the room. Clearly, now more than ever before in this century, there is a need for such a device which may be simply constructed and not require considerable financial investment by the homeowner.

SUMMARY OF THE INVENTION

The foregoing needs which seemingly are not met by the prior art are provided by the device of this invention which is used in a fireplace to transfer heat energy from a source into a room into which the fireplace faces. The fireplace includes a firebox having a hearth, a chimney connected through a flue to the firebox and means for holding an energy source such as, for example, wood. The device includes means which is interposed between the hearth and the chimney and which has at least one curved portion that is adjacent the room for causing air heated by the energy source to flow in a tortuous path around the curved portion toward the room and then toward the chimney. Products of combustion elevate the temperature of means attached to or formed integrally with the interposed means and cause substantial heat energy to be transferred therefrom by radiation and convection. Facilities which in a preferred embodiment are adjustable are provided for supporting the interposed means above the energy source and spaced a predetermined distance from an upper depending wall that in part defines the firebox opening and causes the heat energy which is transferred therefrom radiantly and convectively to be directed into the room.

BRIEF DESCRIPTION OF THE DRAWINGS

Other features of this invention will be more readily understood from the following detailed description of specific embodiments thereof when read in conjunction with the accompanying drawings in which.

DETAILED DESCRIPTION

Figure 1:
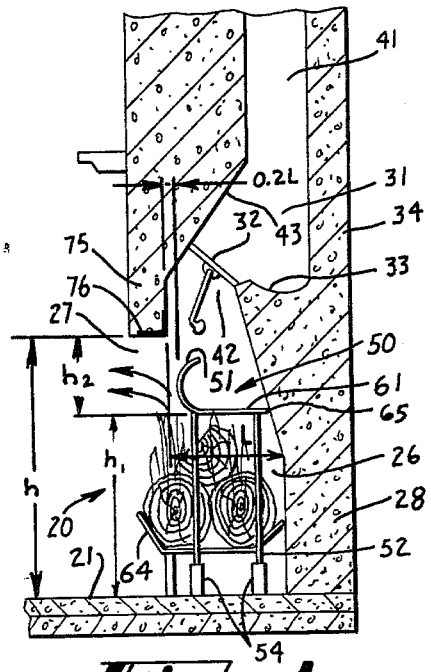
FIG. 1 is an end view in section of a fireplace which includes a device of this invention.

Referring now to FIG. 1, there is shown a fireplace, designated generally by the numeral 20, which embodies this invention. The fireplace 20 includes a hearth 21 which may be at the same level as or raised above a floor of a living area into which the fireplace faces. The hearth 21 is generally built of fire brick but it may also be constructed of hard brick, concrete or stone or other non-combustile, heat-resistant materials.

The hearth 21 may communicate to an ash pit (not shown) which is the hollow area into which ashes fall through an ash dump located in the hearth. A door that opens to a basement or to an outside wall allows access to the ash pit for the occasional removal of ashes.

The fireplace 20 includes a firebox 26 in which energy sources such as wood, coal or the like and which communicates with a living area through an opening 27 are burned. The firebox 26 is formed for example by metal sides and a rear wall which are correctly proportioned for burning and venting without causing smoke to be generated and directed into the living area.

A smoke chamber 31 which communicates with the firebox 26 through a damper 32 is important to the capability of producing and maintaining a smoke-free fire.

The smoke chamber 31 also includes a smoke shelf 33 which is horizontally disposed, which is usually concave in shape, and which extends rearwardly from the rear of the throat of the firebox 26 to a rear wall 34. Advantageously, the smoke shelf 33 directs or interrupts cold air downdrafts which are present in the early stages of a fire and causes them to eddy and drift upward with the rising air currents. The smoke shelf 33 also catches soot and blocks smoke from puffing into the living area. Both sides of the smoke chamber 31 slope toward a flue or chimney 41 which communicates with the outside of the structure in which the fireplace 20 is located. Moreover, the slope of each side of the fireplace 20 which defines the smoke chamber 31 should be substantially equal, otherwise, a fire will burn on one side of the firebox 26 only. It is also customary to parge the inwardly facing surfaces of the smoke chamber 31 and the smoke shelf 33 with a lining material such as, for example, fire clay mortar.

As can be seen in FIG. 1, the damper extends across an opening 42 which is commonly referred to as a throat and which extends between a sloping front wall 43 of the smoke chamber 31 and the smoke shelf 33. The damper 32 is commonly made of a cast iron material, for example, and is mounted in the fireplace 20 so that it is capable of being opened and closed gradually to control the draft and to prevent the entry of cold outside air when the fireplace is not in use.

Relative areas of portions of the fireplace 20 are important in order to ensure a smoke free fire and to ensure the continuous burning of a fire provided an energy source is supplied to the firebox 26. For example, the firebox includes the opening 27 which faces into the living area and which has a particular width "w" and height "h". The area obtained as a product of this width "w" and height "h" should be in the range of eight to twelve times as great as the cross-sectional opening of the flue 41.

The fireplace 20 as seen in FIG. 1 is provided with a device 50 in accordance with this invention which causes substantially more heat energy to be moved into the living area than that in conventional fireplaces. While other devices which are available in the marketplace and which have been described hereinbefore also cause a greater amount of heat energy to enter the living area than conventional fireplaces, the device 50 of this invention is less complicated in design and much less expensive.

Figure 2:
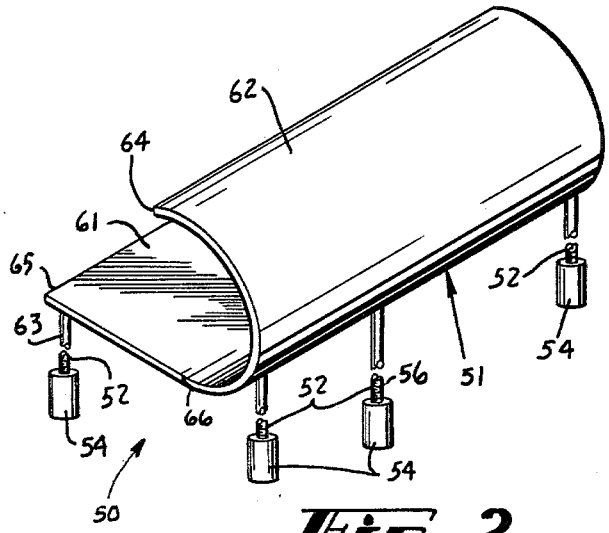
FIG. 2 is a perspective view of the device of this invention.

Referring now to both FIGS. 1 and 2, it is seen that the device 50 includes a heat energy reflector 51 which is supported on four legs 52—52. The legs 52—52 are individually adjustable by threading a lower end of each and turning it into a threaded bore of a base 54. Various means may be provided for equalizing the extent of penetration of each lower end of each leg 52 into its associated base 54. For example, each leg 52 could be provided with a series of notches 56—56. Both the legs 52—52 and the heat reflector 51 are preferably constructed of a heavy gauge steel, such as for example 5/16".

Going now to the heat reflector 51, FIG. 2 shows that it includes a generally planar portion 61 and a curved portion 62. The planar portion 61 is attached to upper ends 63—63 of the legs 52—52 and is disposed substantially horizontally across the width of the firebox 26 and adjacent the rear wall 28. In a preferred embodiment, an inner longitudinal edge 65 is in engagement with the rear wall 28 (see FIG. 1). Of course, the legs 52—52 are constructed of such a length that the planar portion 61 is above an energy source such as wood which may be supported on a grate 64 (see FIG. 1) that rests on the hearth 21.

The dimensions and the positioning of the device 50 of this invention within the firebox 26 are important to its efficient operation to transfer heat convectively and radiantly into the living area. For example, and as seen in FIG. 1, a distance "L" from the rear wall 28 to an outermost point on the curved portion 62 is about 80% of a distance "L" from the rear wall 28 to an inside face of the depending wall 75. Also, the planar portion 61 is spaced a distance "$h_1$" above the hearth 21 which is about 50% of the total distance "h" from the hearth to the depending wall.

The curved portion 62 is in the form generally of a half-circle, although other curvatures may suffice. One longitudinal edge 66 of the curved portion 62 is attached to or is integral with the planar portion 61, while the other longitudinal edge portion 64 diametrically opposite the other is spaced thereabove.

Figure 3:
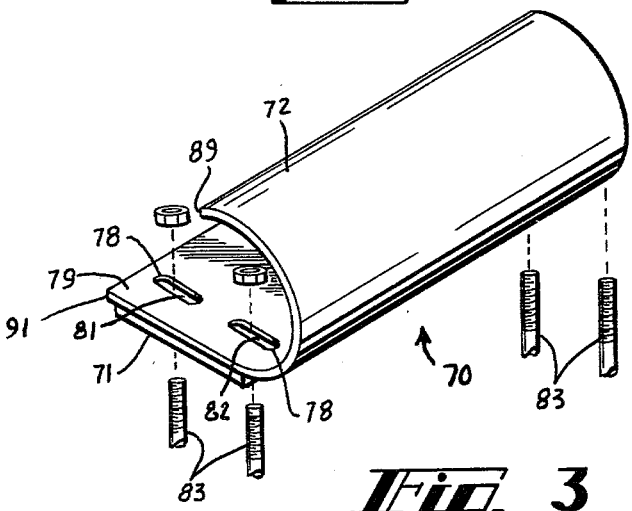
FIG. 3 is a perspective view of a preferred embodiment of this invention.

In a preferred embodiment, a reflector 70 (see FIG. 3) is constructed so that a planar portion 71 and a curved portion 72 are not portions of one plate but rather two separable portions (see FIG. 3). This is preferred in order that the curved portion 72 may be moved horizontally rearwardly toward the rear wall 28 of the firebox 26 or outwardly toward the living area. This is done to control the spacing of the curved surface 72 from a lower depending wall 75 (see FIG. 1) of the firebox 26 which is usually comprised of brick and that is supported by a structural lintel 76.

To provide this adjustable feature, the planar portion 71 may be provided with two spaced slots 78—78 which extend in the direction of the depth of the firebox 26. The curved portion 72 is constructed to include a planar portion 79 which overlaps the planar portion 71. Further, the planar portion 71 is provided with two sets of holes 81—81 and 82—82 with one pair 81 and 82 aligned with each slot 78 to receive fasteners 83—83, such as bolts for example. This allows a user to loosen the bolts 83—83 and move the curved portion 72 and the bolts along the slots 78—78 until the curved portion is spaced a desired distance from the lintel 76. It should be apparent that upper portions 63—63 of the supporting legs 52—52 could be flanged to support the portion 71 and have threaded ends which function as the bolts 83—83.

Figure 4:
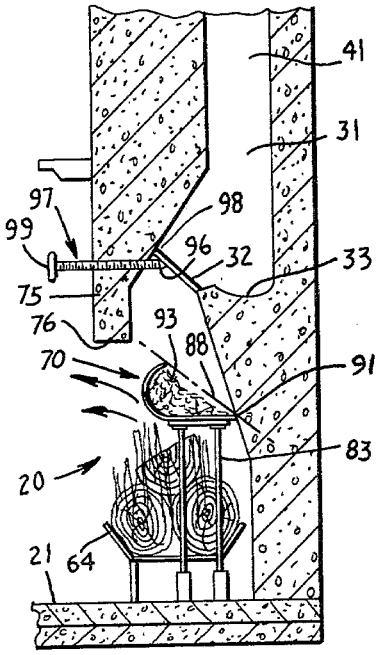
FIG. 4 is an end view in section of a fireplace which includes the preferred embodiment of this invention and showing insulation mounted therein for further improving its efficiency.

Because the reflector 70 is constructed of heavy gauge steel, a fire therebelow causes the plate to rise to a substantially high temperature which causes a substantial amount of heat energy to be directed into the living area by radiation. Of course, without more, the surface of the curved portion 72 which faces toward the rear wall 28 of the firebox 26 also radiates heat energy and this escapes upwardly through the throat 31 and the flue 41. In order to overcome this loss, the space defined by that surface of the reflector 70 and an imaginary line 88 (see FIG. 4) between a free longitudinal edge 89 of the curved portion 72 and a longitudinal edge 91 of the planar portion 71 or edge 92 of the curved portion 72 adjacent the rear wall 28 of the firebox 26 is filled with an insulative material 93 having a substantially high R value, such as, for example, 19. As is generally known the opening or the closing of the damper 32 may be somewhat awkward because of location of the handle adjacent the top of the firebox which is used to control the damper. This problem is overcome by pin-connecting an inner end 96 of a threaded control member 97 which extends through the front wall 75 to a free longitudinal edge 98 of the damper 32. The member 97 includes a knob 99 by which the user can precisely control the turning of the member and hence the position of the damper 32 which leads to the smoke chest 31.

Figure 5:
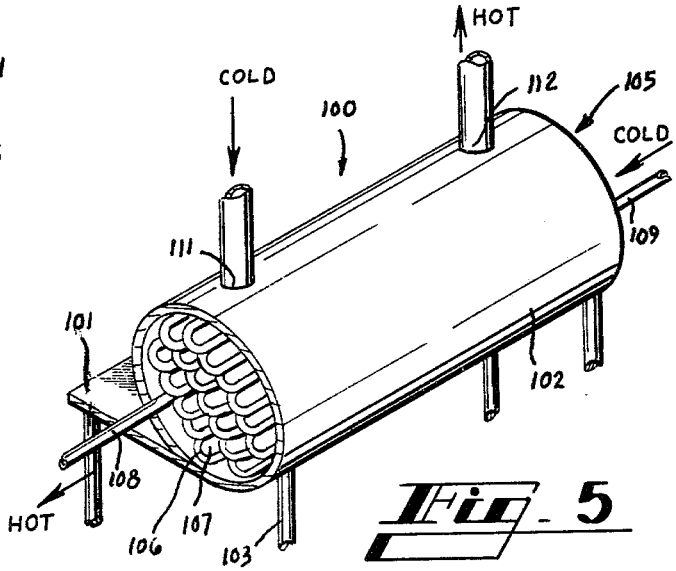
FIG. 5 is a perspective view of still another embodiment of this invention which includes a circulatory system for heating a liquid.

Referring now to FIG. 5, there is shown another embodiment of this invention which is used not only to heat an adjacent living area but also which is used to provide hot water. Such hot water may be used in an applicance such as, for example, a dishwasher, for bathing or for a baseboard hot water heating system.

A device designated generally by the numeral 100 includes a planar portion 101 and a portion 105 which includes a cylindrical portion 102 which are attached together along a line of tangency at the bottom of the cylindrical portion. Four legs 103—103 support the portions 101 and 102 above a hearth 21. Provisions may be made as shown in FIG. 3 for connecting the portion 105 to the planar portion 101 to provide for horizontal adjustment toward or away from the wall 75.

The device 100 also includes a continuous metallic conduit 106 which is routed in a plurality of loops 107—107 within the cylindrical portion 102. The conduit 106 which may be run to a using applicance (not shown) such as a hot water heater exits from the device along a portion 108 and re-enters along a portion 109.

In order to transfer heat most efficiently from the cylindrical portion 102 of the device 100, which is positioned in a firebox 26 as is the device 70, to the conduit 106, the cylindrical portion 102 is closed at each end and is filled with a liquid such as water. The heat transfer water enters the cylindrical portion 102 through an entrance port 111 and may be circulated out of the cylindrical portion through an exit port 112.

It is to be understood that while the foregoing embodiments have been described in the environment of a so-called fixed fireplace which is constructed as an integral part of a home, the invention is not so limited. For example, the device 20 could also be used in the firebox of a free-standing fireplace such as for example one which is referred to as a Franklin stove.

It should be understood that the above-described arrangements are simply illustrative of the invention. Other arrangements may be devised by those skilled in the art which will embody the principles of the invention and fall within the spirit and scope thereof.

What I claim is:

1. A device which is adapted to be supported from a hearth of a fireplace to heat a room into which the fireplace faces, the fireplace including a firebox having a rear wall, side walls, and a flue that is connected through a damper to the firebox, said device comprising:

a heat energy conductor adapted to be interposed between a hearth and a damper and extending longitudinally in a direction between side walls of the fireplace for causing air heated by an energy source to be directed toward the room and for causing substantial heat energy to be radiated therefrom, said conductor including:

an elongated planar portion adapted to assume a substantially horizontal position in a firebox, said planar portion having one longitudinal edge adapted to be adjacent to a rear wall of the firebox and another longitudinal edge between the rear wall and the room into which the fireplace faces, said planar portion having lateral edge surfaces extending between said longitudinal edges and being spaced from side walls of the fireplace; and a convexly curved portion having one longitudinal edge connected to the other longitudinal edge of said planar portion and another longitudinal edge unattached with its center of curvature being between it and the rear wall, said curved portion adapted to be positioned a selected distance from an upper depending wall of the fireplace to provide a continual opening between it and the upper depending wall which cooperates with the damper above the firebox to control the air currents from the room to the flue; and a plurality of supporting legs for holding said heat conductor a distance above the hearth to space said curved portion a selected distance from the upper depending wall, said supporting legs each being capable of being moved in a vertical direction to move said heat conductor upwardly or downwardly to space said curved portion the selected distance, said legs being distributed generally adjacent to a perimeter of said planar portion to permit said legs to have an energy source disposed therebetween.

2. The device of claim 1, wherein said planar portion is a first planar portion and said heat conductor of said device further includes a second planar portion to which said legs are connected, said second planar portion being disposed below said first planar portion and extending longitudinally therewith, said second planar portion having a longitudinal edge portion which engages the rear wall, and having means for supporting slidably said first planar portion to permit said first planar portion to be moved horizontally in a direction away from the rear wall of the firebox or in a direction toward the rear wall to adjust the spacing of said curved portion from the upper depending wall of the firebox.

* * * * *